United States Patent [19]

Lucas

[11] 4,448,641

[45] May 15, 1984

[54] METHOD FOR EVACUATING EMISSIONS OF A COKE OVEN

[75] Inventor: August Lucas, Datteln-Horneburg, Fed. Rep. of Germany

[73] Assignee: Firma Carl Still GmbH & Co. K.G., Fed. Rep. of Germany

[21] Appl. No.: 368,050

[22] Filed: Apr. 14, 1982

[30] Foreign Application Priority Data

Apr. 15, 1981 [DE] Fed. Rep. of Germany ..... 3115217

[51] Int. Cl.[3] ..... C10B 33/00; C10B 41/02

[52] U.S. Cl. ..... 201/41

[58] Field of Search ..... 201/41; 202/263, 270

[56] References Cited

U.S. PATENT DOCUMENTS

| | | | |
|---|---|---|---|
| 3,746,626 | 7/1973 | Morrison | 202/263 |
| 4,087,333 | 5/1978 | Naevestad | 202/263 |
| 4,096,040 | 6/1978 | Grosko | 202/263 |
| 4,211,612 | 7/1980 | Stog | 202/263 |
| 4,312,713 | 1/1982 | Mayer et al. | 202/263 |
| 4,334,963 | 6/1982 | Stog | 202/263 |

FOREIGN PATENT DOCUMENTS 2021863 12/1971 Fed. Rep. of Germany .

*Primary Examiner*—Bradley Garris

*Attorney, Agent, or Firm*—McGlew & Tuttle

[57] ABSTRACT

A coke oven handling apparatus for use with a coke oven having a battery of horizontally arranged side by side coke ovens with a quenching car trackway for a coke quenching car disposed alongside the battery outwardly of a coke cake guide car which is also movable along the ovens of the battery on a guide car trackway comprises a stationary closed gas exhaust system which has an exhaust connection adjacent the quenching car. The support structure provides a support for a hood and a trackway for the hood adjacent the quenching car trackway and a structure is supported upon and movable along the hood support and trackway structure. The hood structure includes a first hood portion of vertically deep size which is adapted to be positioned adjacent a coke cake guide car in a position to overlie coke being pushed through the guide car into the quenching car. The hood structure also includes an at least one additional hood area advantageously one of shallow depth which is also connectable to the exhaust connection to cover a portion of the quenching car which moves beyond the first hood portion after the initial discharge of coke has been exhausted through the first hood portion. The apparatus includes additional controls and ducts connectable to the second hood portion at locations along the length of the car as it advances and with a control device arranged in the passage of the car for actuating these devices as the car is moved so as to sequentially increase the exhaust suction and exhaust area over the quenching car as it is advanced.

5 Claims, 3 Drawing Figures

METHOD FOR EVACUATING EMISSIONS OF A COKE OVEN

FIELD AND BACKGROUND OF THE INVENTION

This invention relates in general to coke ovens and in particular to a new and useful apparatus and method for evacuating emissions at the coke side of a coke oven furnace while pushing out coke cake from oven chambers.

From German Pat. No. 20 21 863, a hood is known which is suitable for carrying out a method, similar to the invention, and which, in its operating position, is connected to the opening of a coke oven chamber in a dustproof manner by means of sealing strips which are provided between a box-section coke guide and the oven and the hood.

Further known from this reference is a partition dividing the hood into a high portion corresponding to the height of the coke guide and a low portion of substantially smaller height, extending toward the quenching tower. In addition, this reference teaches that exactly predetermined proportions of the available total suction power of the exhaust system are applied to the different portions of the hood. As from the start, the once adjusted suction power is applied to all of the exhaust connections, which means that the suction is applied even in areas where no emission occurs as yet, so that a large amount of infiltrated air is taken in at those locations. This calls for an unnecessarily high total suction power requiring a larger rating and cross sections, and increasing investment as well as operating costs.

SUMMARY OF THE INVENTION

The invention is directed to a better utilization of the available suction power and thus to a reduction of operating and capital investment costs.

In accordance with the invention, glowing coke which is pushed out of each coke oven through a coke guide car is directed through a hood structure which travels along with the guide car and which is connected through a stationary exhaust connection through a flexible connection. After an initial discharge of coke is dumped into the car, the car advances and its forward end moves beneath a further hood portion which is connected to the exhaust only after the guide car advances sufficiently to effect an operation of this second exhaust system.

According to experience, the maximum dust emission may occur at the start of the pushing operation. Consequently, for the duration of this starting period, the invention provides a method in which all of the exhaust connections at which no emission is expected as yet are locked and the dust is exhausted except in the upper portion of the hood. Only after the first hot coke discharged in the quenching car is no longer aligned with the discharge area, due to the fact that the quenching car is not in position to receive further incandenscant coke, an additional exhaust connection is automatically opened.

Advantageously, the invention includes a hood structure which includes a first portion and at least one additional second portion which have separate connections to the exhaust, which may be serially put into effect. The arrangement is such that as a further additional exhaust connection is made over the car, the previous one will be again closed so that the next exhaust connection remains effective.

This is to always obtain an evacuation at the end of the quenching car while at the same time preventing a substantial reduction of the exhaustion in the discharge area. Also, by providing an evacuation of both ends, an unnecessary additional transverse or back flow of the emission gases in the exhaust tubes is prevented or reduced.

Since high emissions are also to be expected at the end of the pushing operation, as the coke from the pusher side is discharged into the quenching car, it is advantageous to provide, in accordance with the invention, that at the end of the pushing operation, the exhaust power is reduced and thereafter again increased to a maximum.

In accordance with a feature of this invention, the apparatus includes a hood structure which is adapted to travel along the support along with the coke cake guide car and be positioned on the discharge side of the coke cake guide car so that the coke cake may be discharged into the quenching car through a first hood portion which is continuously connected to a fixed exhaust system. The apparatus also includes a second hood portion which is much shallower in depth than the first hood portion and which overlies the portion of the quenching car which moves beyond the first hood portion. As the quenching car is moved it actuates first one valve to connect a first duct to the exhaust system, for the second shallow depth hood portion thereafter at least one additional valve for connecting a further exhaust duct. The valves are advantageously actuated through a linkage secured to the hood which engages with the quenching car as it moves. The quenching car advantageously contains a cam track which regulates the exhaust valve so that one or more exhaust systems can be cut in before applying exhaust vacuum over the hood.

Accordingly, it is an object of the invention to provide an improved cloke evacuation system which comprises a hood which is movable along with a quenching car and a coke cake guide car in front of a battery of coke ovens which is connected to a fixed closed exhaust system through a flexible connection which permits it to be moved alongside each oven in turn and which includes at least one additional hood portion which becomes effective over the car after the coke is discharged through a first hood portion and exhausted while it is being spilled into the quenching car.

A further object of the invention is to provide a method of evacuating emissions of a coke oven which comprises directing coke through a coke cake guide car and through a hood structure which continuously exhausts the emissions of the coke and fills up a portion of the front area of the coke quenching car and further including moving the car relative to the first hood portion to move it under a second hood portion and as the coke car is advanced cutting in at least one additional exhaust connections over the coke car ahead of the portion of the car which receives the initial discharge of the coke.

A further object of the invention is to provide an emission control device which is simple in design, rugged in construction and economical to manufacture.

The various features of novelty which characterize the invention are pointed out with particularity in the claims annexed to and forming a part of this disclosure.

For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
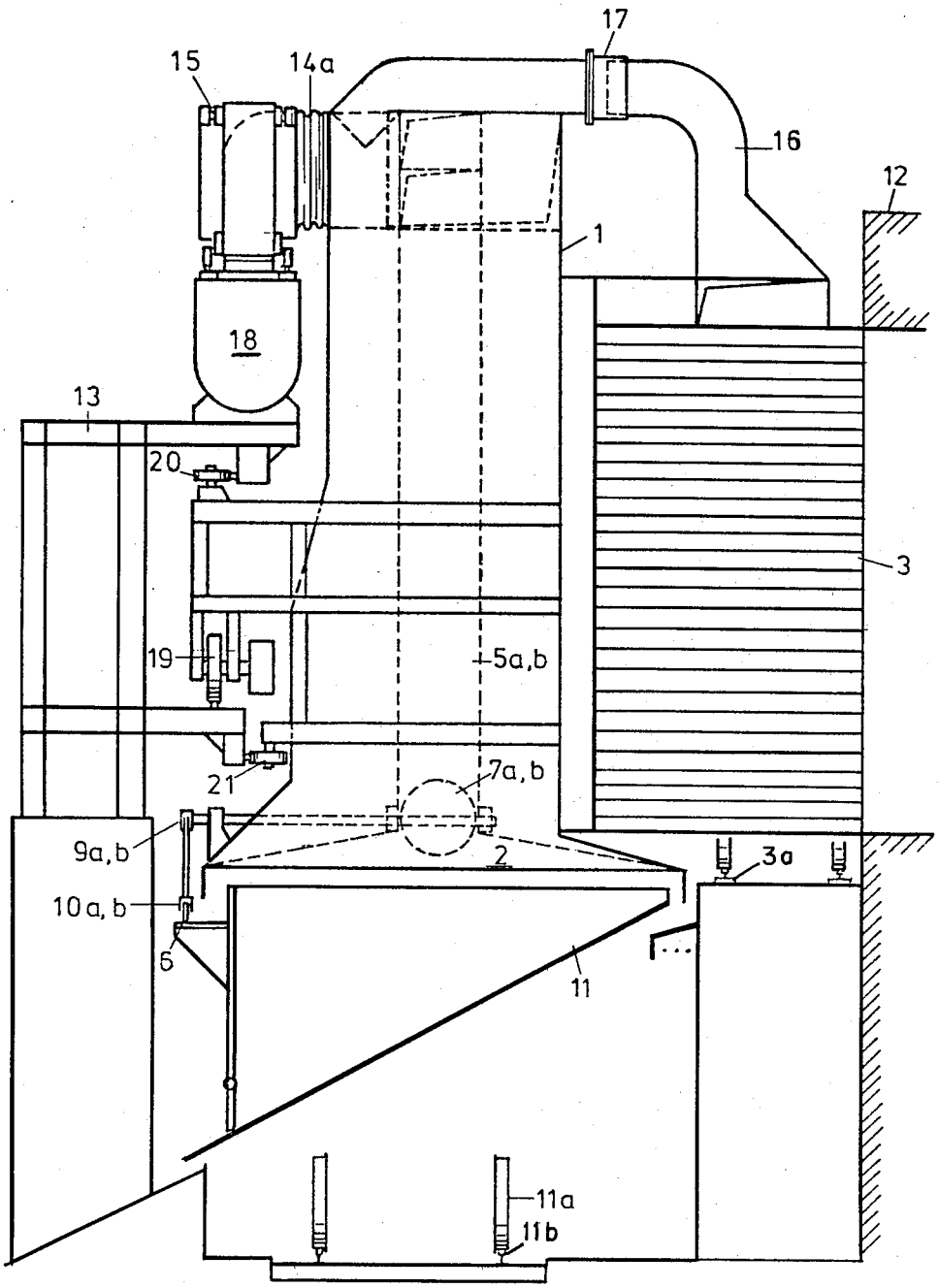
FIG. 1 is a side elevational view of a coke oven battery having emission evacuation system constructed in accordance with the invention.

Referring to the drawings in particular the invention embodied therein comprises a coke handling apparatus for use with a coke oven 12 having a battery of horizontally arranged side by side coke ovens with a quenching car trackway over which wheels 11*a* of a quenching car 11 are moved alongside the battery and outwardly of a coke cake guide car 3 which is also movable along the battery on a guide car trackway 3*a*. The handling apparatus includes a stationary closed gas exhaust system in the form of a gas duct 18 disposed on the combination of hood support and trackway 13 which is disposed adjacent the trackway 11*b* for the quenching car. The stationary closed gas exhaust system has an exhaust connection 14*a* which is connected to the movable hood structure in a manner to permit it to be moved alongside the coke cake guide car 3 adjacent each of the furnaces in a battery.

In accordance with the invention the hood structure includes a first hood portion 1 of a size to overlie a portion of the quenching car 11 across its entire width and in a position to withdraw gases and dust from the glowing cake coke which is pushed from the coke oven through the coke cake guide car 3 and the upper hood portion 1 and into the quenching car 11. In addition, the hood structure includes at least one second portion 2 which extends forwardly of the first hood portion 1 and is of a much shallower depth than the first hood portion. The combined length of the hood portions 1 and 2 is at least as long as the quenching car 11. The arrangement includes control means in the form of automatically shiftable control valves or dampers 7*a* and 7*b* which connect separate gas exhaust channels 5*a* and 5*b* to the fixed gas exhaust system and duct 18 as the coke quenching car 11 is moved beyond the first hood portion 1 past a partition 22 dividing the two portions to the second hood portion 2.

The figures show the inventive mechanism 7 to 10 for controlling the exhaustion of hood 1, 2 in association with a cam track provided on a quenching car 11. The total length of the exhaust hood comprising a first portion 1 having a vertically deep hood chamber and a second portion 2 of shallow depth approximately corresponds, i.e. equals, to that of quenching car 11. Prior to pushing the coke out of the coke oven chamber of a coke oven battery 12, both the coke guide car 3 and the high portion 1 of the hood must be moved into alignment with the opening 1*a* of the coke oven chamber. Then, considering FIG. 2 the left end of the quenching car is in a position below the hood first portion 1 and part of the second portion while the right end of the car is not covered completely at this time. During the pushing operation, the quenching car advances to the left and gradually occupies positions beneath the low hood portion 2, too. Upon advancing up to the first additional exhaust connection 5*a*, a roller 10*a* of linkage 9*a* comes into contact with a cam track 6 provided laterally on quenching car 11, so that as the car moves past, control valve 7*a* is gradually brought from its horizontal into its vertical position and the emission can be evacuated through tube 5*a*. Roller 10*a* may also be moved past a contact piece 6*a* or 6*b* to actuate an electrical limit switch, for example. Now, if the quenching car advances farther below the hood, the other roller 10*b* and linkage 9*b* come into contact with the cam track 6 and the other control valve 7*b* opens. After a certain period of time, roller 10*a* comes to move along the sloping portion of cam track 6 at the right hand side and control valve 7*a* gradually closes, partly or completely. For this purpose, springs 8*a*, 8*b* are provided.

The figures also show the exhaust tubes 5*a* and 5*b* leading to the hood connection and united on their other ends in a gas collecting channel 14. Channel 14 is connected through a flexible portion 14*a* to a gas transfer carriage 15 providing a gastight connection to a stationary exhaust duct 18, even if the hood is in motion. Aside from the two exhaust connections 5*a*, 5*b* at the low portion 2 of the hood, an exhaust space 4 is provided above the high hood portion 1, to which an exhaust tube 4*a* extending over the door opening is connected. A gas exhaust 16 provided above coke guide 3 is connected to collecting channel 4 through a flange portion 17.

Figure 2:
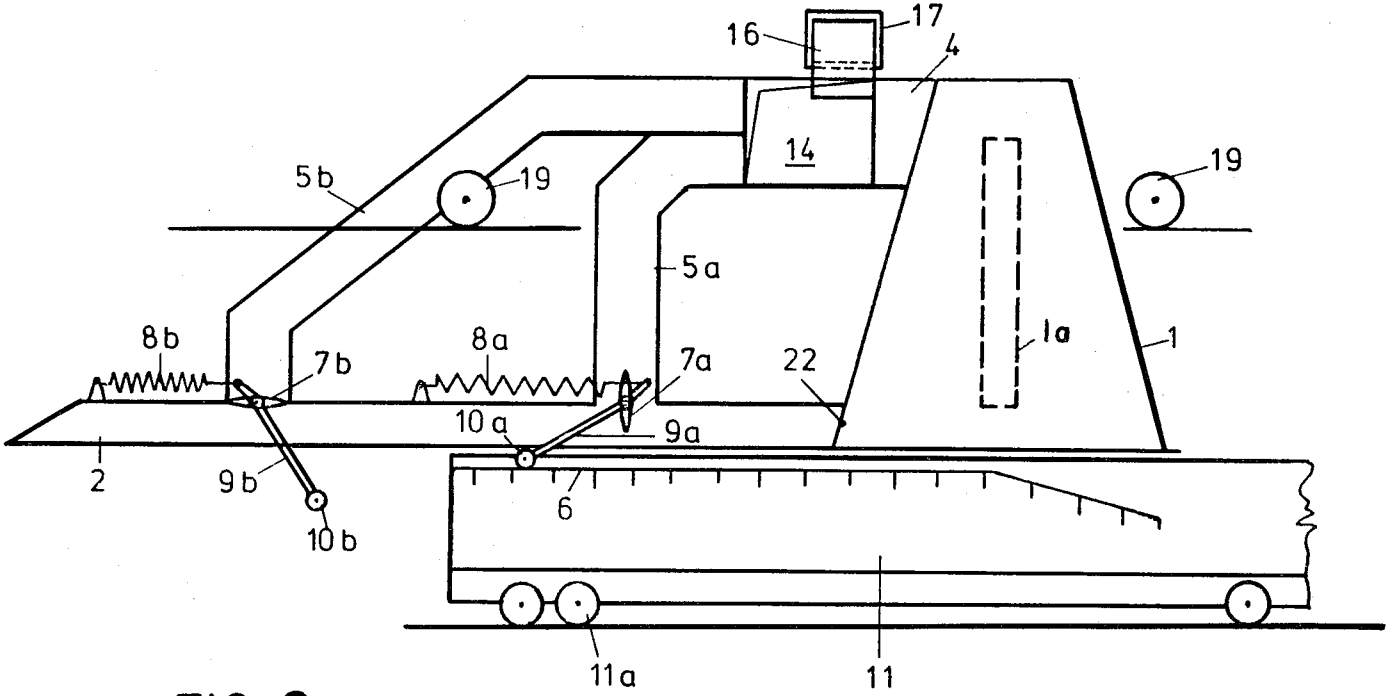
FIG. 2 is a partial front elevational view of the apparatus shown in FIG. 1.
Figure 3:
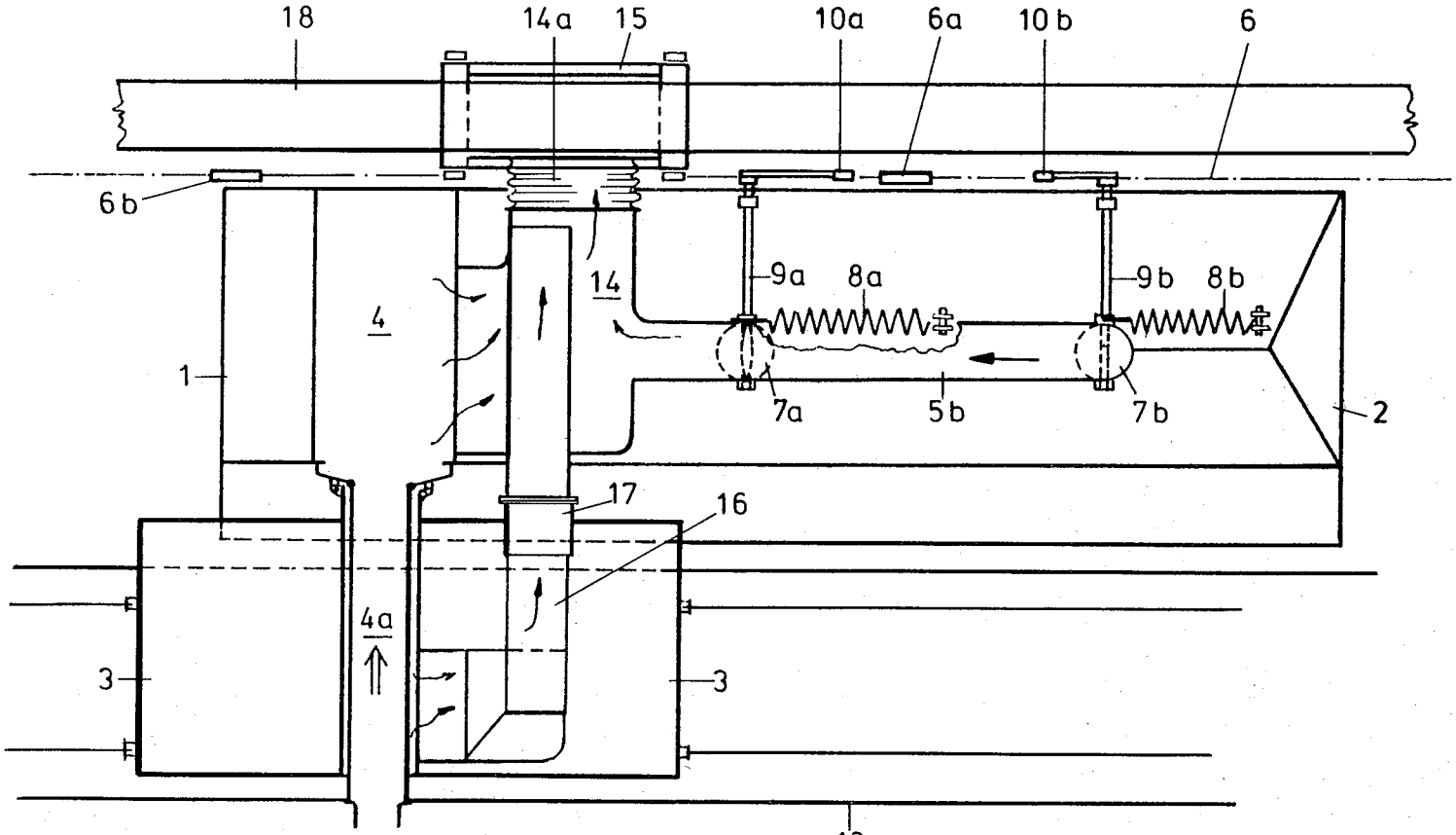
FIG. 3 is a top plan view of the apparatus shown in FIG. 1.

FIG. 1 further shows the carriage or supporting structure 15 for the hoods 1 and 2 and its relation to the stationery exhaust duct 18. The hood structure is supported for traveling on structure 13 through rollers 19, 20, 21. In FIG. 2, a partition 22 is shown which is provided between the high and low portions of the hood and extends downwardly up to the coke load in the quenching car.

While a specific embodiment of the invention has been shown and described in detail to illustrate the application of the principles of the invention, it will be understood that the invention may be embodied otherwise without departing from such principles.

What is claimed is:

1. A method of evacuating emissions caused by glowing coke cake which is pushed over a coke guide car out of a coke oven opening of a coke oven battery, into a quenching car movable in a feed direction along the coke oven battery, using a hood structure which is also movable along the coke oven battery and which has a front portion and a rear portion, the coke oven battery having a fixed exhaust system with a selected amount of suction power for receiving the emissions, and the hood structure having duct means for communicating the coke guide car, the front portion and the rear portion with the fixed exhaust system, the front and rear portions of the hood structure having a combined length in the feed direction at least equal to a length of the quenching car in the feed direction, the method comprising:

positioning the front portion of the hood structure in alignment with the coke oven opening, with the rear portion extending downstream thereof in the feed direction;

moving the quenching car in the feed direction under the front portion;

the coke cake being pushed into the quenching car as it passes under the front portion;

applying the entire selected amount of suction power over the duct means for communicating the coke guide car and the front portion to the fixed exhaust system during a starting period of coke pushing when the quenching car is under the front portion only; and distributing some of the selected amount of suction power to the duct means for communicating the rear portion to the fixed exhaust system as a forward end of the quenching car in the feed direction moves under the rear portion of the hood structure;

the front and rear portions of the hood structure both being provided with a width extending across an entire width of the quenching car, the front portion being higher above the quenching car than the rear portion and sufficiently high to cover an entire height of the coke oven opening, the duct means for communicating the rear portion with the exhaust system including a valve which is activatable by engagement with the quenching car as the quenching car moves in the feed direction under the rear portion.

2. A method according to claim 1, including during an ending portion of the pushing of the coke cake into the quenching car, closing the communication between the rear portion of the hood structure and the fixed exhaust system for again applying the full selected amount of suction power to the front portion of the hood structure.

3. A method according to claim 1 wherein the duct means for communicating the rear portion to the fixed exhaust system includes at least two exhaust connections, each with a valve therein, with a valve in each exhaust connection actuatable in sequence by the movement of the quenching car in the feed direction.

4. A method of evacuating emissions caused by glowing coke cake which is pushed over a coke guide car out of a coke oven opening of a coke oven battery, into a quenching car movable in a feed direction along the coke oven battery, using a hood structure which is also movable along the coke oven battery and which has a front portion and a rear portion, the coke oven battery having a fixed exhaust system with a selected amount of suction power for receiving the emissions, the hood structure having duct means for communicating the coke guide car, the front portion and the rear portion with the fixed exhaust system, the front and rear portions of the hood structure having a combined length in the feed direction at least equal to a length of the quenching car in the feed direction, the method comprising:

positioning the front portion of the hood structure in alignment with the coke oven opening, with the rear portion extending downstream thereof in the feed direction;

moving the quenching car in the feed direction under the front portion;

the coke cake being pushed into the quenching car as it passes under the front portion;

applying the entire selected amount of suction power over the duct means for communicating the coke guide car and the front portion to the fixed exhaust during a starting period of coke pushing when the quenching car is under the front portion only; and distributing some of the selected amount of suction power to the duct means for communicating the rear portion to the fixed exhaust system as a forward end of the quenching car in the feed direction moves under the rear portion of the hood structure;

the duct means including at least two exhaust connections for communicating the rear portion to the fixed exhaust system, the exhaust connections being spaced along the feed direction;

advancing the quenching car in the feed direction under an upstream one of the exhaust connections;

opening the upstream one of the exhaust connections for applying a portion of the selected amount of suction power to the upstream of the exhaust connections;

further advancing the quenching car under the downstream one of the exhaust connections;

opening the downstream one of the exhaust connections for applying a portion of the selected amount of suction power to the downstream one of the exhaust connections; and substantially simultaneously reducing the opening of the upsteam one of the exhaust connections while the downstream one of the exhaust connections is opened;

the duct means including a valve in each one of the two exhaust connections, the method including sequentially opening each valve for applying portions of the selected amount of suction power to the two exhaust connections using the movement of the quenching car to activate each valve.

5. A method according to claim 4, including closing off communication between the two exhaust connections and fixed exhaust system as pushing of the coke cake into the quenching car comes to an end for again applying the full selected amount of suction power to the front portion.

* * * * *